US005498069A

United States Patent [19]

Siebenhofer et al.

[11] Patent Number: 5,498,069

[45] Date of Patent: Mar. 12, 1996

[54] BIT HOLDER WITH A DETACHABLY FIXED BIT BUSHING

[75] Inventors: Gottfried Siebenhofer, Fohnsdorf; Alfred Zitz; Roman Gerer, both of Zeltweg, all of Austria

[73] Assignee: Voest-Alpine Bergtechnik Gesellschaft m.b.H, Zeltweg, Austria

[21] Appl. No.: 351,179

[22] Filed: Nov. 9, 1994

[30] Foreign Application Priority Data

Dec. 1, 1993 [AT] Austria ..... 2434/93

[51] Int. Cl.[6] ..... B23B 31/10

[52] U.S. Cl. ..... 299/81.3; 175/413; 299/106

[58] Field of Search ..... 299/91, 86; 175/413

[56] References Cited

U.S. PATENT DOCUMENTS

| | | | |
|---|---|---|---|
| 3,499,685 | 3/1970 | Kniff | 299/86 |
| 3,841,707 | 10/1974 | Kniff et al. | 299/86 X |
| 4,247,150 | 1/1981 | Wrulich et al. | 299/86 |
| 4,333,687 | 6/1982 | Barnstorf | 299/86 X |
| 4,337,980 | 7/1982 | Krekeler | 299/91 |
| 4,678,238 | 7/1987 | Emmerich | 299/91 X |
| 5,088,797 | 2/1992 | O'Neill | 299/91 |
| 5,370,448 | 12/1994 | Sterwerf, Jr. | 299/91 |

*Primary Examiner*—Hoang C. Dang
*Attorney, Agent, or Firm*—Cushman Darby & Cushman

[57] ABSTRACT

The bit holder (1) is nonpositively connected to a bit bushing (3) with adherence to a pressure per unit of surface area of >100N/mm$^2$ between the conical outer surface of the bit bushing (3) and the inner wall of the receiving bore (2) of the bit holder (1). After the bushing has been driven into the receiving bore (2), the conical outer surface of the bit bushing (3), formed by rectilinear generatrices, protrudes beyond the bore (2) by an excess amount (a).

3 Claims, 1 Drawing Sheet

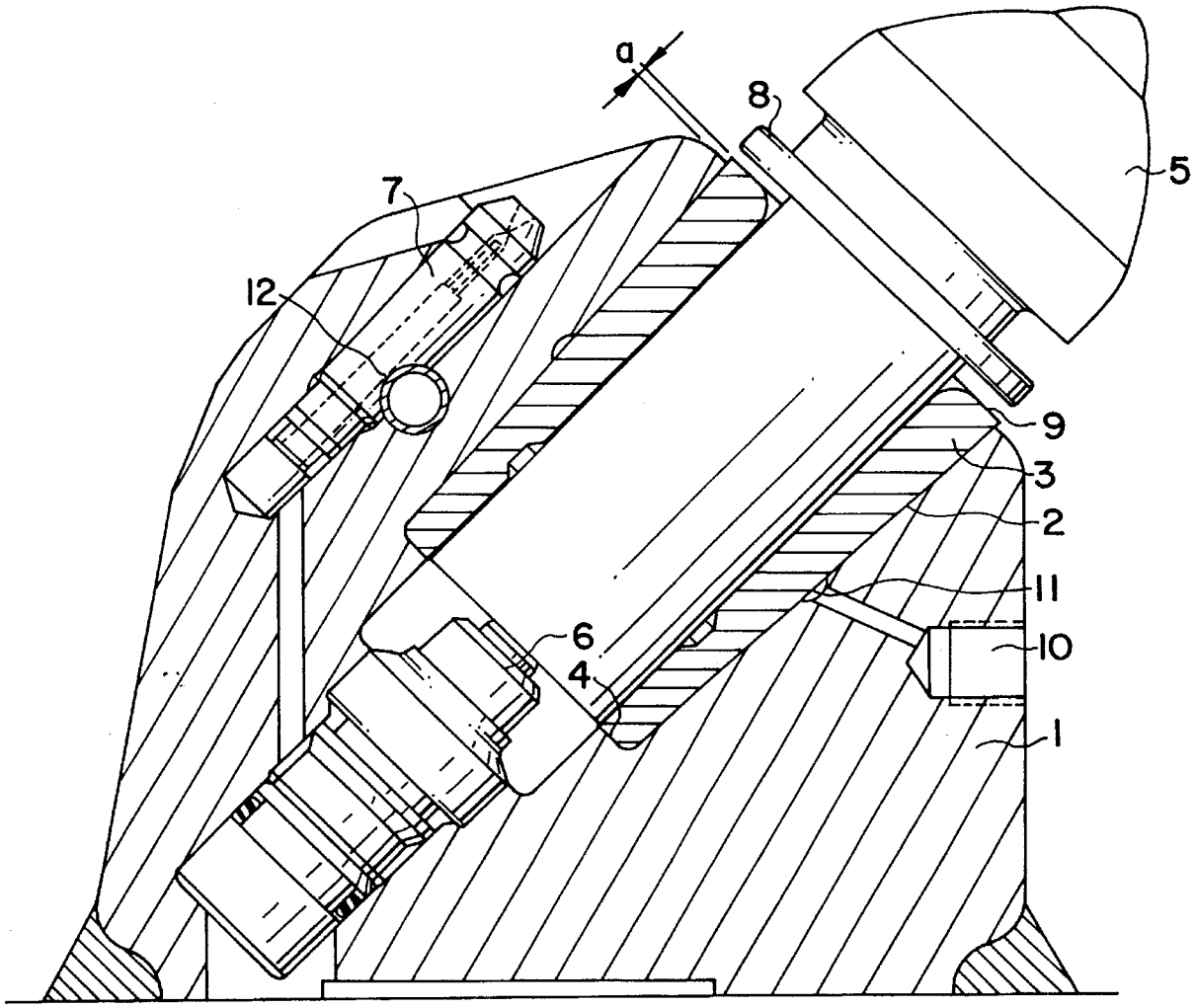
5
8
a
9
3
2
11
10
1
6
4
7
12

BIT HOLDER WITH A DETACHABLY FIXED BIT BUSHING

FIELD OF THE INVENTION

The invention relates to a bit holder with a bit bushing, for receiving a bit for cutting tools. The bushing is fixed in a receiving bore, and the bushing has an axial length that exceeds the axial length of the receiving bore for the bushing provided in the bit holder. A hydraulic line discharges into the gap between the inner surface of the receiving bore of the bit holder and the outer surface of the bushing.

BACKGROUND OF THE INVENTION

A bit holder of known type may be found in German Patent Disclosure DE-C1 29 54 400, for instance. There, a bore that discharges radially into a joint between the bit holder and a sleeve subject to wear was used for forcing in hydraulic fluid, especially hydraulic oil, so as to make the sleeve easier to pull out. In such a bit holder the bit was received so as to be movably supported in the axial direction. The forces of reaction were partly absorbed by an annular flangelike shoulder of the bit bushing; with the bushing embodied essentially cylindrically, it was intrinsically impossible to entirely preclude axial reciprocation of the bushing. The bushing was designed as a part subject to wear, and with such an embodiment, replacing the part made it possible to lengthen the service life of a bit holder multiple times.

Other embodiments with axially displaceable round-shaft bits that are rotatably supported in a bushing disposed in a bit holder may be found in Austrian Patent 386 252, for instance. In the device known from this reference, the axial inward displacement of the bit was limited by its striking a collar of the bushing. To prevent loosening of the bushing under impact strain, an external thread was provided on the bushing, and the thread was screwed to an internal thread of the bit holder.

One feature common to all the known embodiments is that although loosening of the bushing in the bit is intended to be avoided to the maximum possible extent, conversely simple detachability of the bushing is intended to be assured. In all the known embodiments, reaction forces of the bit were absorbed on annular-edgelike stop shoulders of the bushings, and in this way an embodiment was never created in which there is a common composite body between the bushing and the bit holder, in which body it is possible to preclude a relative sliding motion during operation.

OBJECT AND SUMMARY OF THE INVENTION

The object of the present invention is to achieve a section modulus of the bit holder and an improved load- bearing capability of the bit holder with the bit bushing by means of a common composite body, in which nevertheless replacing the bit bushing can easily be done without additional tools, and a sliding motion between the bit bushing and the bit holder is prevented. The invention also seeks to absorb all the reaction forces solely within the material of the bit bushing and in particular to keep vulnerable portions of the receiving bore of the bit holder from being overloaded.

To attain this object, in the embodiment according to the invention, essentially the bushing has a conical outer surface with rectilinear generatrices, and the receiving bore has a hollow conical inner surface; in operation, the bushing is inserted with a pressure per unit of surface area > 100N/mm$^2$ against the hollow-conical inner surface face of the receiving bore against a stop on the bottom of the receiving bore, and the part of the bit bushing protruding beyond the edge of the receiving bore has an outer diameter that is equivalent to the inner diameter of the edge of the receiving bore, with the tolerance being predetermined by the conicity of the outer jacket of the bushing.

By means of the conical embodiment, known per se, in principle it becomes easier to remove defective bushings. At the same time, by means of the dimensioning according to the invention, it can now be assured that when the bushing is driven into the bit holder or the bit holder receiving bore during assembly, a minimum pressure per unit of surface area is assured, which makes it possible to call the thus-assembled bit holder a composite body, since the requisite pressure per unit of surface area prevents relative sliding motion between the bit bushing and the bit holder. For the adjustment and attainment of the requisite minimum pressure per unit of surface area, however, it is also essential that the bushing be driven in against a stop on the bottom of the receiving bore, so that the limitation in known embodiments resulting from the stop shoulders being at the edge of the bore no longer ensues. Driving the bushing in against a stop on the bottom of the receiving bore makes it possible in each case to attain the desired pressure per unit of surface area, the result of which is the improvement in load-bearing capability of the bit holder and the increase in section modulus of the bit holder. To reliably avoid a double seat, and also to assure that the entire axial length is pressed with the requisite pressure per unit of surface area against the inner surface of the receiving bore, there must be no annular edge and no stop shoulder on the outside of the bushing, and it is essential that the part of the bit bushing that protrudes past the edge of the receiving bore have an outside diameter that is equivalent, with the tolerance predetermined by the conicity of the outer surface of the bush, to the inside diameter of the edge of the receiving bore. This embodiment at the same time assures that the bit, in its sudden motion and in its axial displacement in the bushing, will always collide with only the end face of the part of the bit bushing that protrudes past the receiving bore, so that only axial forces need to be absorbed by the bushing there, and that these forces can be reliably absorbed because of the pressure per unit of surface area associated with the entire bit holder. The axial forces during the cutting operation are thus absorbed only by the bit bushing and not, as in known embodiments, by the edge of the bit holder receiving bore, and further conduction of these forces into the bit holder is reduced by the friction forces along the bit bushing, via the stop at the bottom of the bit holder receiving bore; moreover, the effect of slightly off-center forces is substantially reduced over what would be the case at the edge of the receiving bore.

Overall, the embodiment of the bit holder and bit bushing as a common composite body brings about a substantial improvement in service life, compared with known embodiments.

A preferred further feature of the bit holder of the invention is that the generatrices of the outer surface of the bushing form an angle with the axis thereof of <3.5°, preferably from 2° to 3°. This kind of embodiment makes it possible, when the bushing is driven in against the stop on the bottom of the receiving bore, to build up the desired pressure per unit of surface area, while nevertheless enabling easy, problem-free removal of defective or worn bit bushings without the aid of additional tools.

Advantageously, the embodiment according to the invention is dimensioned such that the pressure per unit of surface area between the inner surface of the receiving bore and the outer surface of the bushing is adjusted to be substantially constant over the entire axial length of the bore and amounts to approximately 150N/mm$^2$.

The invention will be better understood from the ensuing detailed description of an exemplary embodiment taken in conjunction with the drawing.

BRIEF DESCRIPTION OF THE DRAWING

The sole figure of the drawing is a schematic illustration, partly in section, of the bit holder according to the invention.

DESCRIPTION OF THE PREFERRED EMBODIMENT

The drawing shows a bit holder 1, into whose hollow-conical receiving bore 2 a bit bushing 3 is driven in against a stop 4 on the bottom of the receiving bore. A bit 5 is inserted, so as to be limitedly axially displaceable, into the bit bushing 3. The axial displaceability of the bit during operation serves to actuate a valve 6 for action upon a spray nozzle 7 that is intended to settle dust or to suppress spark formation when the bit 5 is used for work in rock.

The bit bushing 3 has an axial length that is greater by the dimension a than the axial length of the receiving bore up to the stop 4, so that in operation this axial length a protrudes from the receiving bore of the bit holder 1. In an axial reciprocating motion, the annular shoulder 8 of the bit 5 can collide with the end face 9 of the bit bushing, so that in such an impact, only axial forces are introduced into the bit bushing 3. Because of the conicity and because of the driving in of the bit bushing 3 into the receiving bore 2 of the bit holder 1, it is possible to assure a pressure per unit of surface area of approximately 150N/mm$^2$ between the cooperating surface faces of the receiving bore 2 of the bit holder and the bit bushing 3.

To make removal of a worn bit bushing 3 easier, a hydraulic fluid connection 10 is provided, which discharges in a middle region at 11 into the gap between the outer surface of the bit bushing and the inner surface of the receiving bore of the bit holder.

Reference numeral 12 indicates a locking member for the nozzle 7.

The excess amount a of the bit bushing relative to the bit holder assures that axial forces during the cutting operation will be absorbed solely by the bit bushing 3, and not by the bit holder 1, and will be carried on into the bit holder 1 via the stop 4 in the bottom of the receiving bore 2 only to a reduced extent as a result of the friction forces along the generatrices of the bit bushing. Overall, because of the pressure per unit of surface area between the bit bushing 3 and the inner wall of the receiving bore 2 of the bit holder 1, the result is an increase in the section modulus of the bit holder and an improved load-bearing capability of the bit holder, since the bit bushing 3 and bit holder 1 can be considered a composite body.

What is claimed is:

1. A bit holder provided with a bit bushing for receiving a bit for cutting tools, the bushing being fixed in a receiving bore and having an axial length that exceeds the axial length of the receiving bore, and a hydraulic line which discharges into the gap between an inner surface of the receiving bore and an outer surface of the bushing, wherein said outer surface of the bushing is conical with rectilinear generatrices, and the inner surface of the receiving bore is a hollow conical surface, the bushing during operation being inserted with a pressure per unit of surface area >100N/mm$^2$ against the hollow-conical inner surface face of the receiving bore against a stop on the bottom of the receiving bore, a portion of the bit bushing protruding beyond an edge at the top of the receiving bore having an outer diameter that is equivalent to the inner diameter of the edge of the receiving bore with the tolerance predetermined by the conicity of the outer surface of the bushing.

2. A bit holder according to claim 1, wherein the generatrices of the outer surface of the bushing form an angle with the axis thereof of <3.5°.

3. A bit holder according to claims 1 or 2, wherein the pressure per unit of surface area between the inner surface of the receiving bore and the outer surface of the bushing is adjusted to be substantially constant over the entire axial length of the bore and amounts to approximately 150N/mm$^2$.

* * * * *